United States Patent [19]

Sauer et al.

[11] 4,394,973

[45] Jul. 26, 1983

[54] INJECTION VALVE

[75] Inventors: Rudolf Sauer, Benningen; Wolfgang Kienzle; Werner Paschke, both of Schwieberdingen; Waldemar Hans, Bamberg, all of Fed. Rep. of Germany

[73] Assignee: Robert Bosch GmbH, Stuttgart, Fed. Rep. of Germany

[21] Appl. No.: 249,297

[22] Filed: Mar. 30, 1981

[30] Foreign Application Priority Data

Apr. 3, 1980 [DE] Fed. Rep. of Germany ..... 3013007

[51] Int. Cl.[3] ..... F02M 61/16; F02M 61/18; F02M 51/08

[52] U.S. Cl. ..... 239/467; 239/490; 239/585

[58] Field of Search ..... 239/124, 125, 467, 487, 239/490, 533.12, 585, 468

[56] References Cited

U.S. PATENT DOCUMENTS

| | | | |
|---|---|---|---|
| 1,033,603 | 7/1912 | Manly | 239/490 |
| 1,860,347 | 5/1932 | Crowe | 239/487 |
| 2,400,702 | 5/1946 | Messinger et al. | 239/490 X |
| 2,733,960 | 2/1956 | Barfod | 239/490 X |
| 3,450,353 | 6/1969 | Eckert | 239/585 |
| 3,566,851 | 3/1971 | Pfrommer . | |
| 3,614,945 | 10/1971 | Schlagmüller . | |
| 3,949,938 | 4/1976 | Goodinge . | |
| 4,248,296 | 2/1981 | Jezek | 239/487 X |

FOREIGN PATENT DOCUMENTS 851258 10/1960 United Kingdom .

*Primary Examiner*—Andres Kashnikow
*Attorney, Agent, or Firm*—Edwin E. Greigg

[57] ABSTRACT

A fuel injection valve is proposed for fuel injection systems of internal combustion engines, which serves to supply fuel into the intake tube of the engine. The injection valve includes a movable valve element which cooperates with a fixed valve seat, downstream of which are provided horizontal fuel guidance bores which discharge tangentially into a spin chamber. The spin chamber is disposed so that it widens conically in the flow direction. The fuel guidance bores simultaneously serve as metering bores. The spin chamber causes an axial speed component to be imparted to the fuel entering via the fuel guidance bores. As a result, the dwell time of the metered fuel within the spin chamber is short, and even in the case of quite short injection pulses, the fuel is still sufficiently well prepared.

4 Claims, 2 Drawing Figures

INJECTION VALVE

BACKGROUND OF THE INVENTION

The invention relates to an injection valve having a movable valve element, a fixed valve seat and horizontal fuel guidance bores discharging into a spin chamber. An injection valve in which a cylindrical spin chamber is provided is already known in the art. This injection valve has the disadvantage, however, particularly when the injection quantities are small, that the dwell time of the fuel in the spin chamber is too long.

OBJECT AND SUMMARY OF THE INVENTION

It is a principal object of the injection valve according to the invention that the dwell time of the fuel in the spin chamber is very short compared to that of prior art injection valves.

It is another object of the invention to provide an injection nozzle in which the fuel is still fully prepared for combustion even when the injection pulses are quite short.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
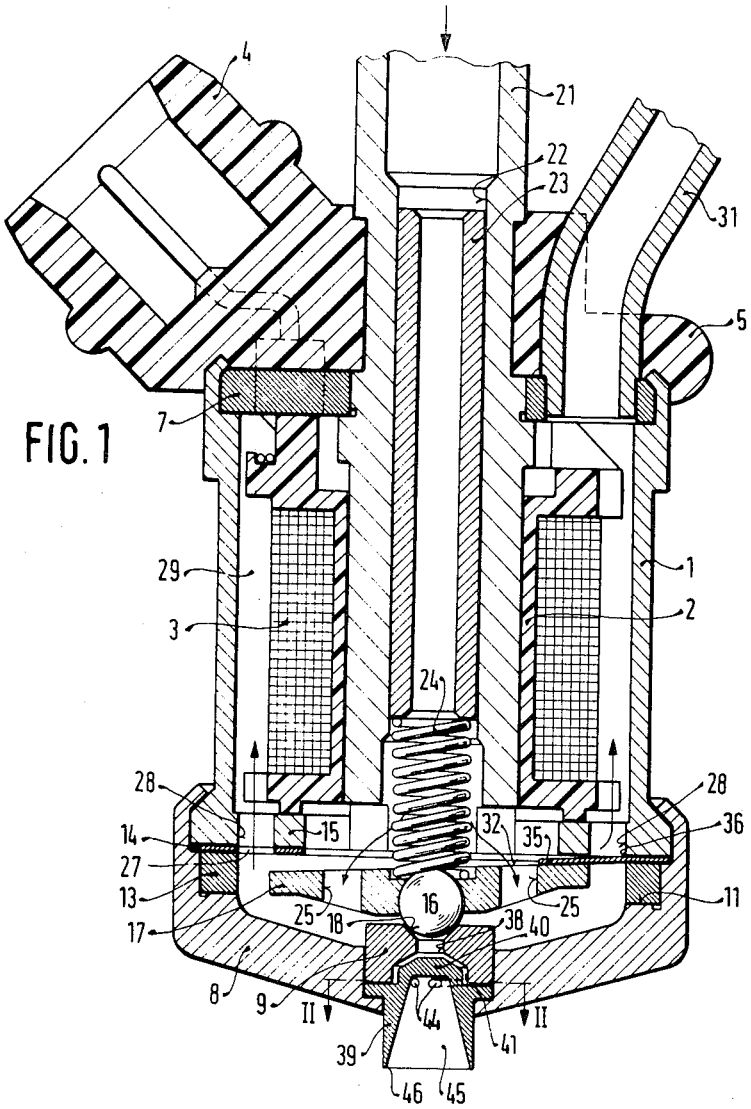
FIG. 1 is a cross-sectional view of an injection valve having a spin chamber according to the invention.

Referring now to the drawings, the fuel injection valve shown in FIG. 1, intended for use in a fuel injection system, serves to inject fuel, particularly at low pressure, into the intake tube of mixture-compressing internal combustion engines having externally-supplied ignition. A valve housing 1 is provided with a magnetic coil 3 disposed within it on a coil carrier 2. The magnetic coil 3 is supplied with current via an electrical plug connection 4, which is embedded in a plastic ring 5 fitted axially upon the valve housing 1 as a cap. A closure plate 7 is recessed into the end of the valve housing 1 beneath the plastic ring 5 and adjacent to the electrical plug connection 4. By means of flanging and then welding or soldering, this closure plate 7 can be attached to seal the valve housing 1 at this end. A nozzle carrier 8 is provided with flanges also to seal the valve housing 1 at the end of the fuel injection valve remote from the electrical plug connection 4. A valve seat body 9 is centrally disposed in this nozzle carrier 8.

A stroke ring 13 is provided on an annular step 11 recessed into the interior of the nozzle carrier 8. A remnant air disc 14 is disposed against the stroke ring 13, and both elements are held in place by the force of pressure created by the flanging of the nozzle carrier 8 tightly onto the valve housing 1. The remnant air disc 14, which is manufactured of non-magnetic spring material, such as a cobalt-nickel-chrome alloy, extends radially at least partially over a bottom portion 15 of the valve housing 1 remote from the electrical plug connection 4, thus preventing a flat armature 17 from magnetically adhering to the bottom portion 15. A ball 16 is provided as the movable valve element; it is firmly connected with the flat armature 17 and cooperates with a conically shaped fixed valve seat 18 disposed in the valve seat body 9. The supply of fuel, such as gasoline, is effected via a central fuel inflow nozzle 21, which simultaneously acts as the core upon which the coil carrier 2 is disposed. A tubular insert 23 is coaxially disposed in the inflow bore 22 of the fuel inflow nozzle 21. A closing spring 24 is provided between the end of this tubular insert 23 adjacent the flat armature 17 and the flat armature 17. In the non-excited state of the magnetic element comprising the coil 3 and the bottom portion of the valve housing 15, this closing spring 24 presses the ball 16 against the valve seat 18 of the valve seat body 9, closing the valve. The fuel flowing into the fuel injection valve via the fuel inflow nozzle 21 proceeds through apertures 25 provided in the flat armature 17 to the actual valve means proper, comprising the valve seat body 9, the valve seat 18 and the ball 16. From the valve means, the fuel can flow past the outer circumference of the flat armature 17, for instance via recesses 27 in the remnant air disc 14 and via apertures 28 in the bottom portion 15 of the valve housing 1, into a coil chamber 29 disposed between the magnetic coil 3 and the valve housing 1. The coil chamber 29 communicates with a fuel return flow line, now shown, via a fuel outflow nozzle 31.

A spring tongue 35 is formed from a portion of the remnant air disc 14. On an end extending radially inwardly from spring tongue clamping point 36 on the valve housing 1, the spring tongue 35 abuts the flat armature 17 on the side 32 thereof remote from the fixed valve seat 18, and is positively connected thereto by soldering or welding. The flat armature 17 may thus execute a pivoting movement about the spring tongue clamping point 36 on the housing 1.

Alternatively, the spring tongue 35 need not absolutely be shaped out of the body of the remnant air disc 14; it may instead be a separate element comprising a piece of spring sheet metal clamped such that it is positively attached to the housing. As a result of the unitary affixation of the flat armature 17 to the spring tongue 35, one is assured that the flat armature 17 can execute only a pivoting movement, and that pivot occurs exclusively about the spring tongue clamping point 36.

When the coil assembly assumes the excited state, the flat armature 17 is attracted by the magnetic coil 3, so that the ball 16 then moves to reveal a flowthrough cross section opposite the valve seat 18, by way of which the fuel can flow into a bore 38 provided in the valve seat body 9.

Figure 2:
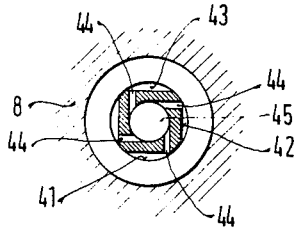
FIG. 2 is a transverse sectional view taken along the line II—II of FIG. 1.

In unit with the valve seat body 9, a nozzle means 39 is provided in the nozzle carrier 8, with a protrusion 40 on said nozzle means fitted into a complementary recess 41 in the valve seat body 9. As shown by way of example in FIG. 2, the nozzle means 39 includes intermediate chambers 43 disposed between the wall of the recess 41 and flattened areas 42 provided on the protrusions 40 so that fuel can flow from the bore 38. A horizontal fuel guidance bore 44 may be provided branching off from each intermediate chamber 43; in the illustrated exemplary embodiment, there are four such fuel guidance bores 44, which discharge tangentially into a spin chamber 45 disposed within the nozzle means 39. The fuel guidance bores 44 comprise throttle bores and serve the purpose of fuel metering. In accordance with the invention, the spin chamber 45 is embodied in a frusto-conical shape such that it widens outwardly in the direction of fuel flow. At the wall of the spin chamber 45, an axial speed component is imparted to the fuel flowing into the spin chamber 45. As a result, even when the injection pulses occur in very rapid sequence, the metered fuel will exit the spin chamber 45 fully prepared for combustion before the next metered quantity of fuel discharged by the subsequent injection pulse enters the spin chamber 45.

The invention thus assures that the same initial conditions prevail for each injection procedure effected by the injection pulse. A rotating fuel film is formed on the wall of the spin chamber 45, but is separated at the end of the spin chamber 45 on a so-called breakaway edge 46 causing the fuel to enter the intake tube in conical form. The wall of the spin chamber 45 is disposed at an angular inclination to the injection valve axis which is less than ca. 20° and is preferably ca. 10°.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An injection valve for fuel injection systems of internal combustion engines including a movable valve element associated with a fixed valve seat in a valve seat body, said valve seat body having an annular wall recess downstream of said valve seat, a nozzle means downstream of said valve seat having horizontal fuel guidance bores therein, said nozzle means having an end portion having a plurality of flat sides, said end portion protruding into said recess, and intermediate chambers formed between the sides of the end protrusion and the wall of said recess, said horizontal fuel guidance bores extending from said intermediate chambers to a spin chamber in said nozzle means, said spin chamber having a frusto-conical interior wall, said fuel guidance bores extending tangentially of said spin chamber interior wall whereby fuel is tangentially discharged into said spin chamber, the interior wall of said spin chamber diverging outwardly in the direction of flow whereby a fuel stream emerges from the spin chamber in a conical configuration.

2. An injection valve as defined by claim 1, in which said injection valve has a longitudinal axis and the interior wall of the spin chamber diverges outwardly at an angular inclination to said axis of less than 20°.

3. An injection valve as defined by claim 2, in which said interior wall of the spin chamber has a length so that fuel exiting from the fuel guidance bores is fully prepared in the spin chamber for combustion and all of the fuel has been discharged from the spin chamber before the next injection pulse.

4. In an injection valve as defined by claim 3, in which said fuel guidance bores comprise metering bores.

* * * * *